US006687929B2

(12) United States Patent
DeFranks et al.

(10) Patent No.: US 6,687,929 B2
(45) Date of Patent: Feb. 10, 2004

(54) BOX SPRING CORNER GUARD

(75) Inventors: Michael S. DeFranks, Decatur, GA (US); Richard F. Gladney, Fairburn, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 0 days.

(21) Appl. No.: 10/284,535

(22) Filed: Oct. 30, 2002

(65) Prior Publication Data

US 2003/0110562 A1 Jun. 19, 2003

Related U.S. Application Data

(63) Continuation of application No. 09/974,234, filed on Oct. 10, 2001, now Pat. No. 6,493,887.

(51) Int. Cl.[7] ..... A47C 23/00
(52) U.S. Cl. ..... 5/254; 5/717; 5/261; 248/345.1
(58) Field of Search ..... 5/254, 259, 260, 5/261, 717, 907; 248/345.1

(56) References Cited

U.S. PATENT DOCUMENTS 3,406,411 A 10/1968 La Reis
5,265,291 A 11/1993 Callaway
5,628,080 A 5/1997 Quintile
5,864,906 A 2/1999 Pacelli
5,878,455 A 3/1999 Patterson
6,125,488 A 10/2000 Vogland et al.
6,286,161 B1 9/2001 McCall
6,493,887 B1 * 12/2002 DeFranks et al. ..... 5/254

* cited by examiner

*Primary Examiner*—Michael F. Trettel
(74) *Attorney, Agent, or Firm*—Ropes & Gray, LLP

(57) ABSTRACT

A box spring corner guard is disclosed which protects and reinforces the corner of a box spring. The box spring corner guard consists of a curved body having the shape of a 90 degree section of an imaginary cylinder with a concave inner surface and a convex outer surface. A locator flange extends from the concave inner surface adjacent the bottom end of the curved body. Strengthening ribs run along the length of the curved body to add rigidity. In one embodiment, the curved body also has a limit flange, similar to the locator flange, extending from the concave inner surface adjacent the top end of the curved body. The curved body is attached to the base of the box spring, but the curved body is not attached to the border wire.

10 Claims, 3 Drawing Sheets

BOX SPRING CORNER GUARD

CROSS-REFERENCE TO RELATED APPLICATIONS

This application is a continuation of U.S. application Ser. No. 09/974,234, filing date Oct. 10, 2001, now U.S. Pat. No. 6,493,887, naming Michael S. DeFranks and Richard F. Gladney as inventors, the specification of which is herein incorporated by reference.

FIELD OF THE INVENTION

This invention relates to a corner guard for a box spring or mattress foundation.

BACKGROUND OF THE INVENTION

The term box spring or mattress foundation is commonly used to describe any mattress support system. Conventionally, the corners of a box spring construction are stuffed with foam, cotton, or scraps of other fibrous material to pack the corners to give a suitable and attractive upholstered finished product. Often these conventional materials and stuffing methods are inadequate to keep the corners of box springs filled and contoured during use and handling. Consequently, such conventional materials and stuffing methods may allow the corners of the box springs to become concave during use and handling.

In addition, conventional materials and stuffing methods may result in manufacturing inefficiencies. Because the conventional materials used for stuffing the corners of a box spring are compressible fillers, the compressibility of the fillers may result in a corner being understuffed for the size of the perimeter border. For example, when a perimeter border is cut too small, an assembler may be unable to pack the corners with an acceptable level of material, and the box spring upholstery must be removed and box spring remanufactured.

The prior art has addressed the problem of box spring corners. Callaway U.S. Pat. No. 5,265,291 assigned to Simmons Company, the assignee of the present invention, discloses a box spring with a corner support. The corner support is made of resilient plastic and includes two snap fitting flanges at the top end of the corner support. The snap fitting flanges of the corner support engage the border wire of the box spring. In one embodiment, the bottom end of the plastic support maybe left unattached to the base of the box spring so that the bottom end of the plastic support floats as the wire grid and border wire move toward and away from the base of the box spring. In another embodiment, the corner support is stapled to the wooden base of the box spring and is plaited so that the plaited portion of the corner support can provide flexibility to the corner support and thereby accommodate the relative movement between the wire grid and the base of the box spring.

While the Callaway patent solves many of the problems associated with stuffed corners on a box spring, the snap fit attachment of the corner support to the border wire implicates other issues that may require improvement. For example, when a fibrous top pad is placed over the wire grid in the Callaway box spring, the fibrous top pad is wrapped around the corner support. Because the fibrous top pad is wrapped around the corner support and because the fibrous top pad must be attached to the border wire, an unsightly bulge results at the four corners of the box spring. Alternatively, the fibrous top pad could be cut to fit the outside dimensions of the border rod. This approach used in conjunction with the Callaway corner support would, however, add cost to the fibrous top pad, be more challenging to manufacture, and compromise quality because the border wire would no longer be wrapped by the fibrous top pad. The snap fit of the corner support in the Callaway prior art reference also requires that the material for the corner support be a resilient or flexible plastic material where other nonresilient materials might otherwise be more attractive from a cost standpoint. Moreover, the Callaway snap fit corner support creates a non-uniform top surface with two bumps at each corner where the snap fit flanges engage the border wire. The Callaway snap fit corner support also requires that the border wire be of a known and constant diameter and that the corner of the border wire be free of any crosswires of the wire grid. Finally, the Callaway snap fit corner support requires a repetitive finger pinch force action during the manufacturing process. Ergonomically, repetitive finger pinch movements by installers should be avoided.

SUMMARY OF THE INVENTION

The box spring corner guard of the present invention addresses the problems associated with stuffing box spring corners as well as the issues associated with the prior art resilient plastic box spring corner supports. Particularly, the box spring corner guard of the present invention has been designed to replace conventional materials used to pack and fill the corners of a box spring and to improve upon the prior art resilient plastic corner support.

The box spring corner guard of the present invention is adapted for use with a box spring having a base, typically a wood lattice, and a wire grid supported by means of upright wire supports. Such a box spring has a border wire extending around the periphery of the wire grid. The border wire is connected to the crosswires of the wire grid and to the upright supports.

The box spring corner guard of the present invention comprises a curved body having the shape of a 90 degree section of an imaginary cylinder. The curved body has a concave inner surface and a convex outer surface. The curved body has a bottom end and a top end. The length of the curved body extends in a direction parallel to the axis of the imaginary cylinder that defines the shape of the curved body. A locator flange extends from the concave inner surface adjacent the bottom end of the curved body. Strengthening ribs run along the length of the curved body to add rigidity to the curved body. In one embodiment, the curved body also has a limit flange, similar to the locator flange, extending from the concave inner surface adjacent the top end of the curved body.

When incorporated into a box spring to serve as a corner guard, the bottom end of the curved body is attached to the base of the box spring by means of staples, nails, screws, rivets, adhesives, or like at one of the corners of the box spring. The locator flange provides a seat for the corner guard on the base of the box spring to limit relative movement between the corner guard and the base of the box spring in a direction parallel to the length of the curved body. The top end of the curved body extends to a position adjacent the border wire. The top end of the curved body is not attached to the border wire, and a small space exists between the border wire and the concave inner surface of the curved body so that the fibrous top pad covering the wire grid can be tucked between the border wire and the corner guard and attached to the border wire. Because the fibrous top pad covering the wire grid can be tucked between the border wire and the corner guard, the corner guard of the present invention provides a smooth corner finish adjacent to border wire without bulges either on the convex outer surface of the curved body or on the top of the border wire. Moreover, the strengthening ribs along the length of the curved body provided rigidity so that the corner guard is not easily deflected inwardly during use and handling, thus maintaining a smooth concave upholstered surface at the corner of the box spring.

In another embodiment of a corner guard of the present invention, a limit flange is located on the concave inner surface of the curved body adjacent the top end of the curved body. The limit flange is therefore position below the border wire so that movement of the border wire toward the base of the box springs will cause the border wire to contact the limit flange and thus limit relative movement of the border wire toward the base of the box spring. The strengthening ribs along the length of the curved body provide rigidity so that the corner guard with the limit flange can support the corner of the wire grid from deflection toward the base of the box spring.

Therefore, it is an object of the present invention to provide a box spring corner guard that has an appropriately sized full quarter round radius at the corner of the box spring to ensure a smooth fit of the upholstery at the corner of the box spring.

It is also an object of the present invention to provide a box spring corner guard that, because of uniform shape, lessens the degree of accuracy required when sizing the perimeter band or border of the box spring.

Moreover, it is an object of the present invention to provide a box spring corner guard that is rigid enough to withstand being deflected inwardly as a result of ordinary use and handling of the box spring.

Further, it is an object of the present invention to provide a box spring corner guard that is sufficiently rigid to support the border wire and limit deflection of the border wire toward the base of the box spring.

Further objects, features and advantages will become apparent upon consideration of the following detailed description of the invention when taken in conjunction with the drawings and the appended claims.

DESCRIPTION OF THE PREFERRED EMBODIMENT

Figure 1:
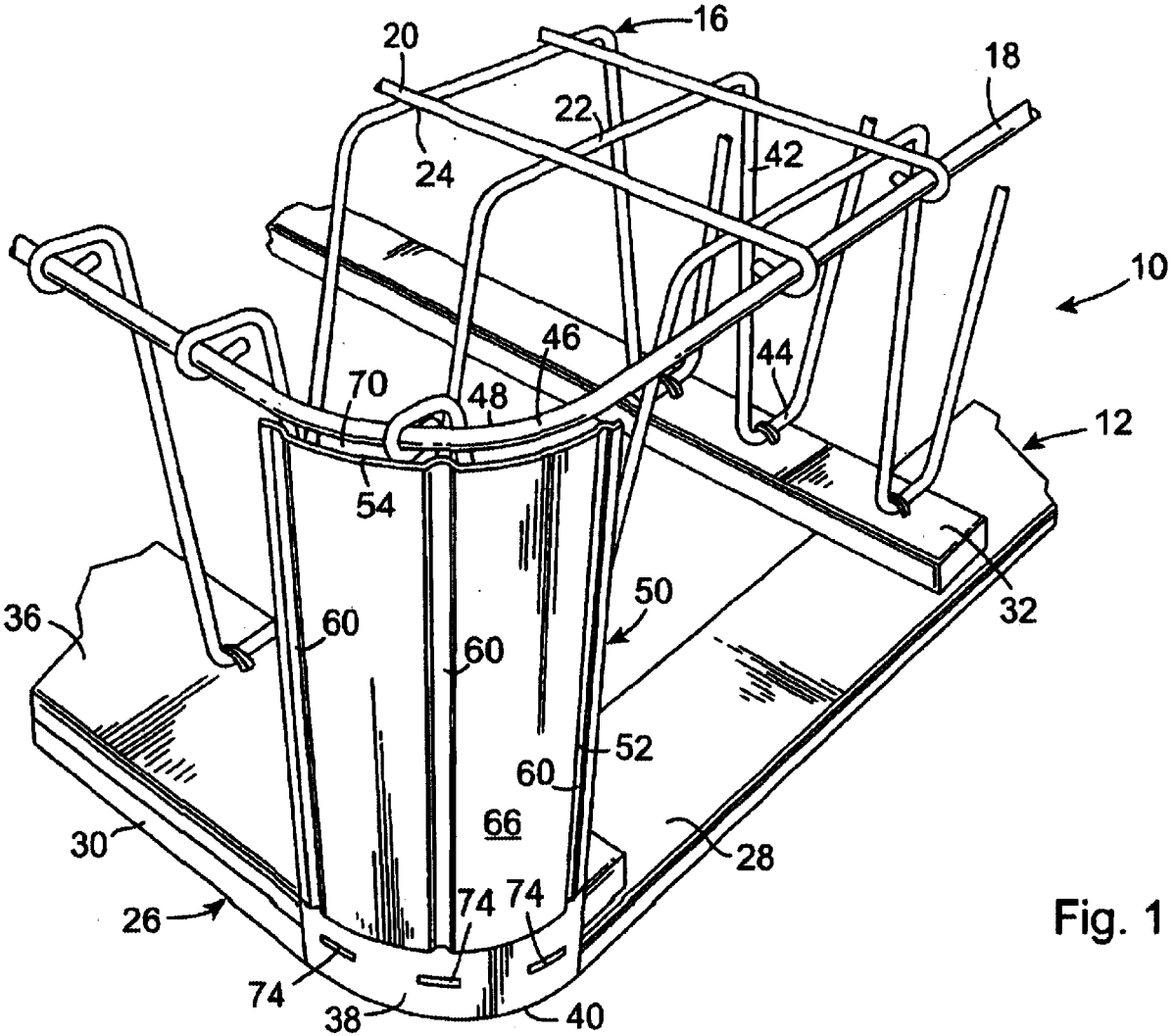
FIG. 1 is a perspective view of a box spring with a corner guard in accordance with the present invention.

Referring now to the drawings, in which like reference numerals represent like parts throughout the several views, FIG. 1 discloses a box spring or foundation 10 on which a corner guard 50, in accordance with the present invention, is mounted. The box spring 10 comprises a base 12, a wire grid 14, and upright supports 16. The base 12 includes a rectangular frame 26 with a pair of side rails (only side rail 28 is shown in FIG. 1). The side rails may be formed from standard lumber of construction grade in nominal 1×3 size, connected at a head end of the frame 26 by a head end rail (not shown) and at the foot end of the frame 26 by a foot end rail 30. The foot end rail 30 may be formed, for example, from standard lumber of construction grade in nominal 1×2 size which butts the side rails in the plane thereof. Cross slats, such as cross slats 32 and 36, are positioned on the upper surfaces of the side rails and extend laterally to span the transverse distance between the side rails. Particularly, cross slats 36 lays on top of foot end rail 30 and is attached thereto. The base 12 has a corner 38 at the intersection of side rail 28, foot end rail 30, and cross slats 36. The corner 38 is formed with to radius 40.

Each of the upright supports 16 is a continuous wire with an upper portion 22, an upright section 42, and a lower portion 44. The lower portions 44 of the upright supports 16 are stapled to the cross slats, such as 32 and 34 of the base 12. The upper portions 22 of the upright supports 16 form the wire grid 14 along with crosswires 20. The crosswires 20 and the upper portions 22 of the upright supports 16 are connected at their crossing points 24 by welding for other suitable means to complete the construction of the wire grid 14. A border wire 18 extends around the periphery of the box spring 10 and is supported by the crosswires 20 and the upper portions 22 of the upright supports 16. The border wire 18 has a corner 46 with a radius 48. The radius 48 at the border wire corner 46 coincides with the radius 40 of the base corner 38.

Figure 4:
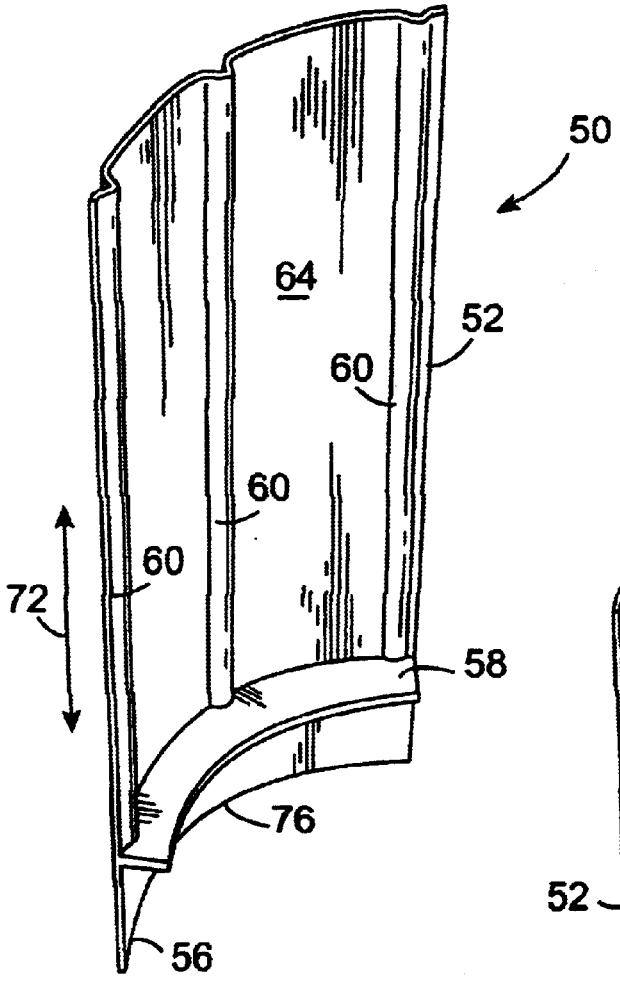
FIG. 4 is an inside perspective view of one embodiment of a corner guard in accordance with the present invention.

Turning to FIG. 4, the corner guard 50 comprises a curved body 52 having the shape of a 90 degree section of an imaginary cylinder with an axial direction 72 and a radius 76. The radius 76 matches the radius 48 of the border wire corner 46 and radius 40 of the base corner 38. The curved body 52 has a concave inner surface 64 and a convex outer surface 66 (FIG. 1), both conforming to the radius 76. The curved body 52 has a bottom end 56 and a top end 54. The length of the curved body 52 extends in the axial direction 72. A locator flange 58 extends inwardly from the concave inner surface 64 adjacent the bottom end 56 of the curved body 52. Strengthening ribs 60 run along the length of the curved body 52 to add rigidity to the curved body 52. The curved body 52 of the corner guard 50 may be molded, extruded, cast, or manufactured in any similar manner of a plastic material such as polyethylene, polypropylene, or the like. The curved body 52 of the corner guard 50 may also be manufactured of paper, corrugated paper, wood, Masonite, fiberglass, metal, or other suitable rigid material.

Returning to FIGS. 1 and 2, the curved body 52 is attached to the corner 38 of the base 12 by means of staples 74 which engage the foot end rail 30, the side rail 28, and the cross slats 36. The curved body 52 could also be attached to the base 12 by means of nails, screws, rivets, adhesives, or like. Because the radius 76 of the curved body 52 matches the radius 40 of the base corner 38, the curved body 52 with its 90 degree segment is self locating at the base corner 38 of the base 12. In addition, the locator flange 58 seats on the top of cross slats 36 to locate the curved body 52 in the axial direction 72 with respect to the base 12. Thus, between the locator flange 58 and the radius 76 of the curved body 52, the curved body 52 is self locating on the base 12, thereby facilitating assembly.

Figure 2:
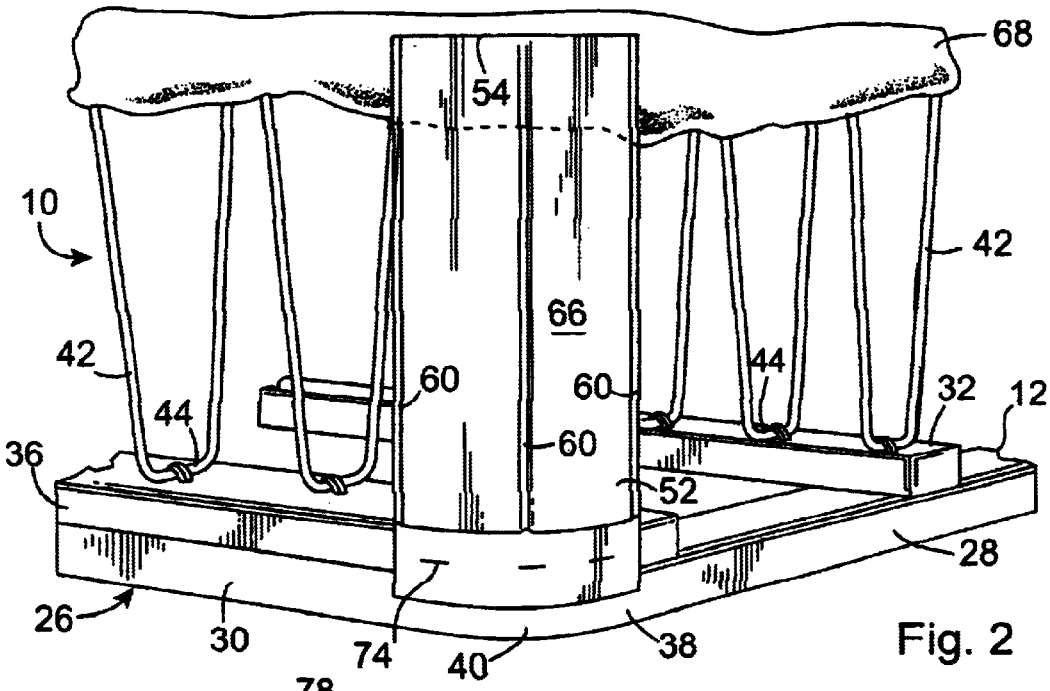
FIG. 2 is a side elevation view of a box spring with a corner guard in accordance with the present invention.
Figure 3:
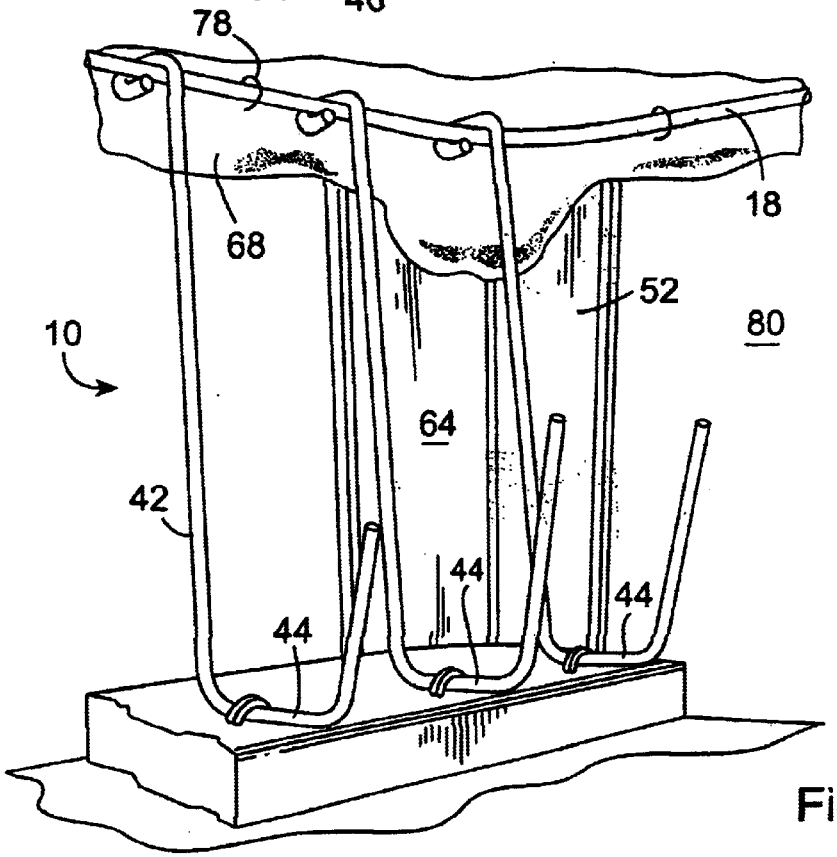
FIG. 3 is an inside elevation view of a box spring with a corner guard in accordance with the present invention.

As can be seen in FIG. 1, the top end 54 of the curved body 52 is not connected to the border wire 18 or any other part of the wire grid 14. In fact, a small space 70 remains between the border wire 18 and the concave inner surface 64 of the curved body 52 adjacent the top end 54 of the curved body 52. As can be seen in FIGS. 2 and 3, a fibrous top pad 68 is laid on top of the wire grid 14, wrapped around the border wire 18, and attached by means of hog rings 78 to the border wire 18. In accordance with the present invention, the fibrous top pad 68 is tucked into the space 70 between the border wire 18 and the curved body 52 at the border wire corner 46. Consequently, the fibrous top pad 68 does not create a bulge at the border wire corner 46. Once the fibrous top pad 68 has been tucked around border wire 18 as shown in FIGS. 2 and 3, the perimeter border upholstery 80 (FIG. 3) is wrapped around the box spring 10 to complete the corner assembly of the box spring 10.

Figure 5:
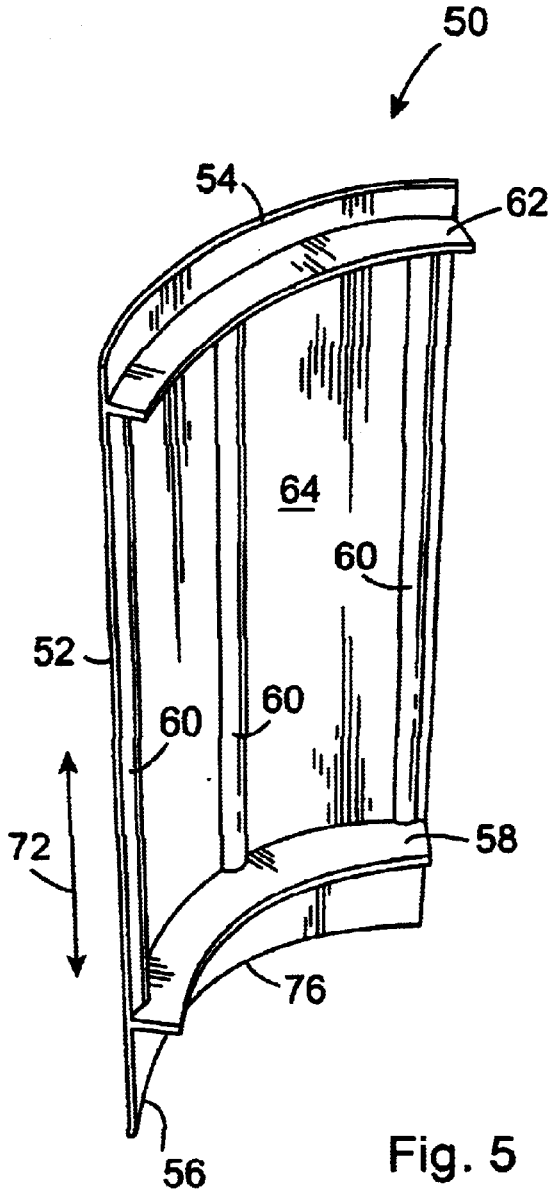
FIG. 5 is an inside perspective view of a second embodiment of a corner guard in accordance with the present invention.

In a second embodiment of the present invention shown in FIG. 5, the curved body 52 also has a limit flange 62, similar to the locator flange 58, extending inwardly from the concave inner surface 64 adjacent the top end 54 of the curved body 52. The curved body 52 with the limit flange 62 is attached to the base 12 in the same manner as previously described. As will be appreciated, the limit flange 62 extends inwardly and is therefore positioned just below the border wire 18, but the limit flange 62 is not connected to the border wire 18. If the wire grid 14 and border wire 18 are loaded, such as by a person sitting on the corner of a mattress supported by the box spring 10, the wire grid 14 and the wire 18 tend to move toward the base 12. The limit flange 62, positioned just below the border wire 18, will contact the border wire 18 as the border wire 18 deflects toward the base 12, and the downward travel of the border wire 18 will be arrested by the limit flange 62. Because the curved body 52 with its strengthening ribs 60 is rigid, the curved body 52 provides support for the wire grid 14 and border wire 18 at the corners of the box spring 10.

We claim:

1. A box spring comprising:

a. a base having at least one base corner;

b. a wire grid including a border wire having at least one border wire corner coinciding with the at least one base corner;

c. upright supports to support the wire grid on the base;

d. upholstery material at least partially covering the box spring at the location of the at least one border wire corner and the at least one base corner; and e. at least one corner guard comprising a side wall of uniform thickness and curved about a longitudinal axis, with a top end, a bottom end, and a locator flange adjacent the bottom end for positioning the corner guard on the base, at least one strengthening rib formed in the side wall and extending in the longitudinal direction from adjacent the top end to at least adjacent the locator flange of the corner guard, wherein the corner guard is attached to the base at the at least one base corner and unattached to the border wire at the coinciding at least one border wire corner.

2. The box spring of claim 1, wherein the box spring further includes a pad that is positioned on top of the wire grid and that wraps around the border wire between the border wire and the corner guard at the border wire corner.

3. The box spring of claim 1, wherein the at least one strengthening rib is formed in the side wall without increasing the uniform thickness of the body.

4. The box spring of claim 1, wherein the corner guard comprises a material selected from the group consisting of a plastic material, paper, corrugated paper, wood, Masonite, fiberglass, and metal.

5. A corner guard for a box spring, comprising a body having a side wall of uniform thickness and curved about a longitudinal axis, with a top end, a bottom end, and a locator flange adjacent the bottom end for positioning the corner guard on a base of the box spring, the corner guard further comprising at least one strengthening rib formed in the side wall and extending in the longitudinal direction from adjacent the top end to at least adjacent the locator flange of the corner guard.

6. The corner guard of claim 5, wherein the corner guard further comprises a limit flange adjacent the top end of the corner guard which, upon deflection of the wire grid, engages the border wire and limits travel of the wire grid toward the base.

7. The corner guard of claim 5, wherein the at least one strengthening rib is formed in the side wall without increasing the uniform thickness of the body.

8. The corner guard of claim 5, comprising a material selected from the group consisting of a plastic material, paper, corrugated paper, wood, Masonite, fiberglass, and metal.

9. A method for manufacturing a box spring comprising the steps of:

forming a box spring having a base with at least one arcuate base corner, a border wire extending parallel to said at least one base and having at least one border wire corner coinciding to said at least one base corner, and upright supports that support said border wire on said at least one base, and attaching to the at least one base corner at least one dual-ended corner guard having a convex side wall of uniform thickness with at least one strengthening rib formed in the side wall, said strengthening rib extending in the longitudinal direction substantially between the two ends of the dual-ended corner guard, wherein the corner guard is unattached to the border wire at the coinciding at least one border wire corner.

10. The method of claim 9, wherein forming the strengthening rib in the side wall includes molding, extruding, and casting the corner guard.

* * * * *